United States Patent [19]

Nakashima

[11] Patent Number: 4,821,976

[45] Date of Patent: Apr. 18, 1989

[54] DUAL REEL STRING WINDING AND UNWINDING APPARATUS FOR USE WITH STUNT KITES

[76] Inventor: Hiroshi Nakashima, 1503 N. Hayden Island Dr., #20, Portland, Oreg. 97217

[21] Appl. No.: 192,152

[22] Filed: May 10, 1988

[51] Int. Cl.[4] ..... B65H 75/40

[52] U.S. Cl. ..... 242/96; 244/155 A

[58] Field of Search ..... 242/85, 99, 100, 100.1, 242/96; 244/155 A

[56] References Cited

U.S. PATENT DOCUMENTS

| | | | |
|---|---|---|---|
| 3,338,536 | 8/1967 | Hull et al. | 242/155 A |
| 3,355,129 | 11/1967 | Kinsey | 242/155 A |
| 3,979,833 | 9/1976 | Grundman | 242/96 X |
| 4,101,090 | 7/1978 | Wait, Jr. | 242/96 |
| 4,129,273 | 12/1978 | Hill | 242/96 X |
| 4,172,567 | 10/1979 | Post | 242/96 |
| 4,176,806 | 12/1979 | Kwon | 244/155 X |
| 4,261,525 | 4/1981 | Wagner | 242/96 X |

FOREIGN PATENT DOCUMENTS

| | | | |
|---|---|---|---|
| 1544479 | 4/1979 | United Kingdom | 242/96 |

*Primary Examiner*—Stuart S. Levy
*Assistant Examiner*—John Eghtessad
*Attorney, Agent, or Firm*—Henderson & Sturm

[57] ABSTRACT

A dual reel string winding and unwinding apparatus for us with stunt kites including a first spool and a second spool, each having two pairs of aligned holes extending through flanges therein. A first and second pair of posts extend through the aligned holes in the first and second spools to cause such spools to rotate together. A connector, having an axle thereon, is connected to the first and second posts and a handle is rotatably mounted on the axle of the connector. One of the posts extends far enough through both spools that it can be utilized as a handle so that by grasping the handle on the axle and the handle on one of the posts, the two reels can be rotated simultaneously together in either direction. A guide is connected to the handle on the axle and is disposed radially outwardly from the spools so as to guide the string either onto or off from the proper spools.

3 Claims, 2 Drawing Sheets

DUAL REEL STRING WINDING AND UNWINDING APPARATUS FOR USE WITH STUNT KITES

TECHNICAL FIELD

The present invention relates to a dual string winding and unwinding apparatus for use with stunt kites and more particularly to such an apparatus which permits the user to easily attach or detach such apparatus and which is easily reversible for right or left hand users.

BACKGROUND ART

Most stunt kites have a left and a right control bridle. To control the kite, one reel of string extends to each of the left and right control bridles. To control a stunt kite, these spools are held, one in each hand, by the user thereof. Since they must be separate during the flying of a stunt kite, in order to do certain maneuvers, there exists a problem of how to unreel the lines when getting ready to launch the kite and to reel in the lines when the kite is being brought back down. It is a very tedious, difficult and slow task to wind or unwind one spool at a time while having the other spool in the users hands. It is very easy to tangle and twist the lines during this process.

U.S. Pat. No. 4,129,273 to Hill shows a double spool kite control mechanism but it is very difficult to control a kite with the spools shown and it is also somewhat awkward to attach and detach the spools in the Hill device.

U.S. Pat. No. 4,172,567 also shows a double reel kite line controlling device which also has reels which are difficult to hold while flying a kite and which tends to be somewhat awkward in its use.

Consequently, there exists a need for a dual reel string winding and unwinding apparatus for use with stunt kites which does not suffer from the shortcomings of the prior art as referred to above.

DISCLOSURE OF THE INVENTION

The present invention relates to a dual reel string winding and unwinding apparatus for use with stunt kites and includes a first spool and a second spool, each having two pairs of aligned holes extending through flanges therein. A first and second pair of posts extend through the aligned holes in the first and second spools to cause such spools to rotate together. A connector having an axle thereon is connected to the first and second posts and a handle is rotatably mounted on the axle of the connector. One of the posts extends far enough through both spools that it can be utilized as a handle so that by grasping the handle on the axle and the handle on one of the posts, the two reels can be rotated simultaneously together in either direction. A guide is connected to the handle on the axle and is disposed radially outwardly from the spools so as to guide the string either onto or off from the proper spools.

An object of the present invention is to provide an improved dual string winding and unwinding apparatus for use with stunt kites.

Another object of the present invention is to provide an apparatus for the aforementioned type which includes reels having a center opening which is large enough to extend a human hand therethrough.

Another object of the present invention is to provide an apparatus of the aforementioned type which allows quick and easy installation of the winding apparatus thereto and likewise permits quick and easy removal of the winding and unwinding apparatus thereto.

Another object of the present invention is to provide a string guiding apparatus attached to a handle for quickly and easily guiding string onto respective ones of two spools.

Other objects, advantages, and novel features of the present invention will become apparent from the following detailed description of the invention when considered in conjunction with the accompanying drawings.

BEST MODE FOR CARRYING OUT THE INVENTION

Figure 1:
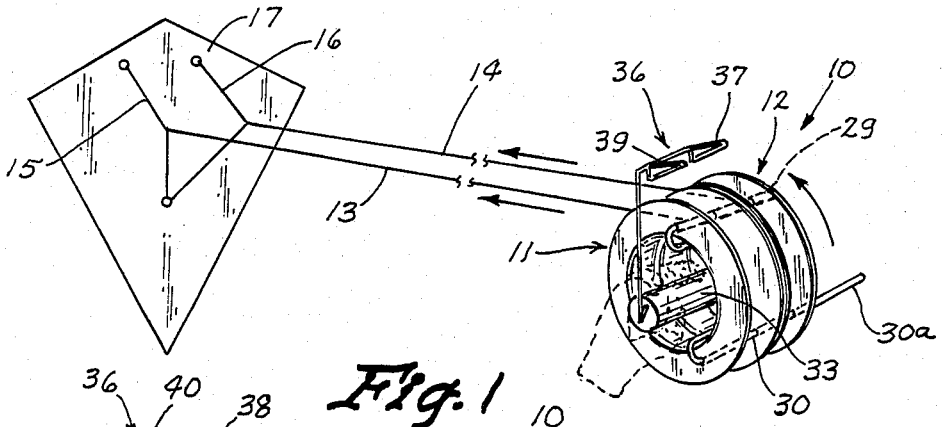
FIG. 1 is a perspective view of a preferred embodiment of the present invention shown attached to a stunt kite and showing how the string on both spools can be unwound simultaneously during the launching procedure.
Figure 2:
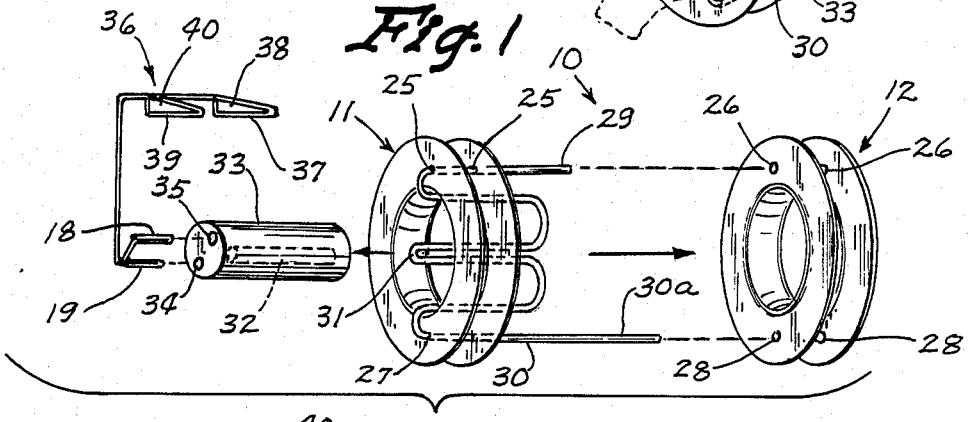
FIG. 2 is a perspective exploded view of the preferred embodiment of the present invention.
Figure 3:
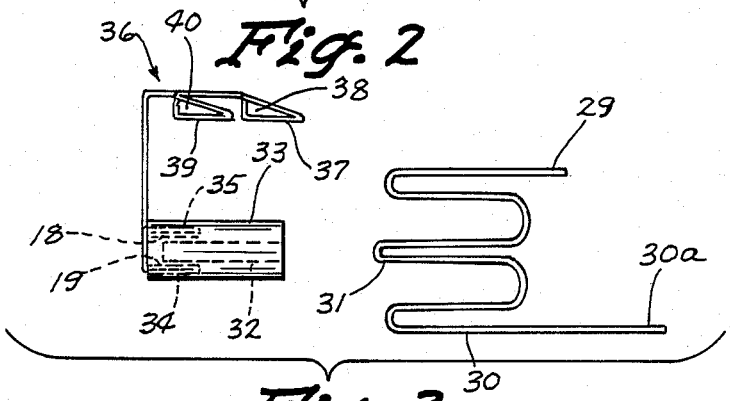
FIG. 3 is a side elevational view of the winding and unwinding apparatus which is separated from the two spools when the kite is being flown, after launching.

Referring now to the drawings wherein like reference numerals designate identical or corresponding parts throughout the several views, FIG. 1 shows a dual string winding and unwinding apparatus (10) constructed in accordance with the present invention and shown unwinding both of two spools (11) and (12) which have string (13) and (14) attached to a left harness (15) and a right harness (16) of a kite (17).

Figure 6:
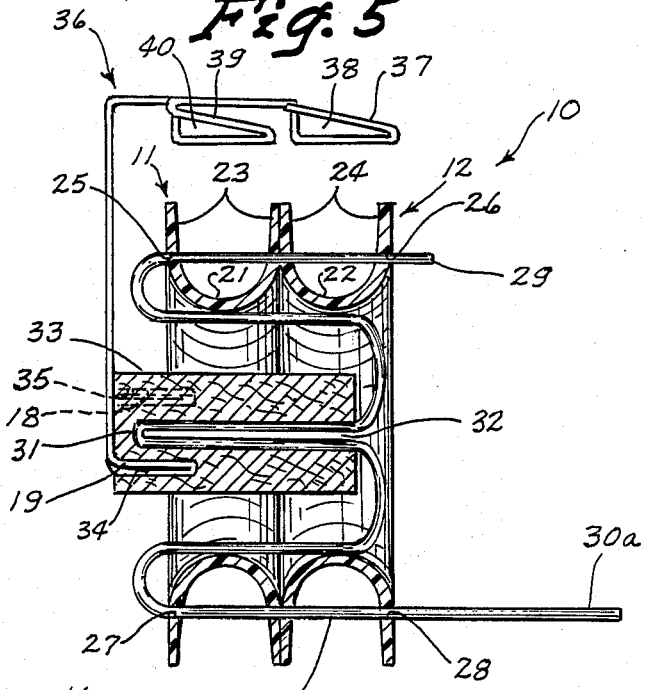
FIG. 6 is an enlarged cross sectional view taken along line 6—6 of FIG. 5.

Referring to FIG. 6, it is noted that the spools (11) and (12) include base member portions (21) and (22) respectively and upstanding flanges (23) and (24) respectively to form an annular shaped area for storing string wound therearound. The flanges (23) of spool (11) have a first and third pair of aligned holes (25) and (27) respectively extending therethrough and the spool (12) has second and fourth aligned pairs of holes (26) and (28) extending therethrough. A first post (29) extends through the aligned pairs of holes (25) and (26) and the post (30) extends through the aligned holes (27) and (28) in the first and second spools (11) and (12).

The posts (29) and (30) are formed in one piece with an internal structure including an axle-like loop (31) which extends into an opening (32) in handle (33). The posts (29) and (30) and the axle (31) are generally formed in one piece, a top portion which looks like a regular S and a bottom portion connected thereto which looks like a mirror image of an S shape.

One end of the handle (33) has depressions (34) and (35) therein for receiving projections (18) and (19) of a string guide (36). These projections (18) and (19) are initially larger than the openings (34) and (35) so they can be compressed slightly, pushed into the openings (34) and (35) and will remain in that position, for example as shown in FIG. 6, by friction.

The string guide (36) includes a first loop (37) for forming a string guide opening (38) and a second loop (39) which forms a string guide opening (40). It will be appreciated that the opening in the top of the loops (37) and (39) allow the string to be easily placed down into the loop or removed therefrom as is needed.

Figure 4:
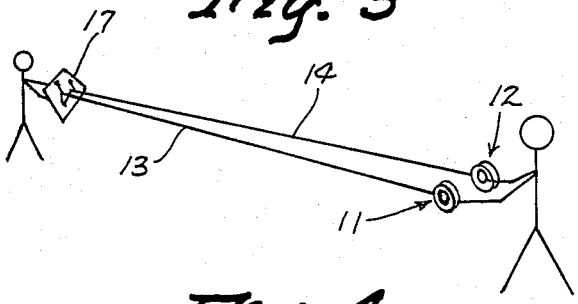
FIG. 4 shows the actual launching procedure schematically after the string has been unwound from the two spools.
Figure 5:
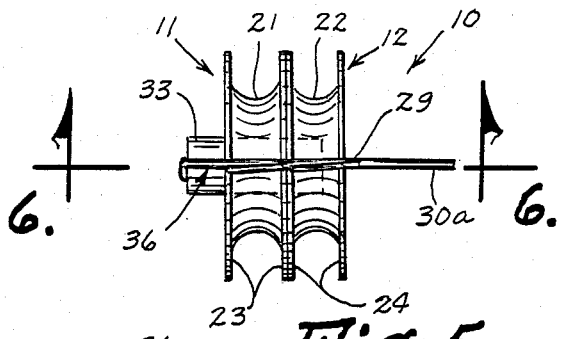
FIG. 5 is a top view of the apparatus shown in FIG. 1.

In order to fly a stunt kite using the apparatus (10), two control lines (13) and (14) of substantially equal length, for example up to about two hundred feet, depending upon the size and shape, are to be used. Before launching the kite, both the left and right control lines (13) and (14) respectively must be unreeled onto the ground, for example by utilizing the preferred embodiment of the invention (10) as shown in FIG. 1. Once a sufficient amount of line has been unreeled, for example as shown in FIG. 4, then the handle (33) is removed and the rod shaped posts and axle (29), (30) and (31) are pulled out of the holes (25–29) in the reels (11) and (12). This allows the person flying the kite to grasp the spools (11) and (12), while another person holds the kite (17) in the position shown in FIG. 4. Then with the wind blowing from the person flying the kite to the person holding the kite (17), the kite can then be launched in a conventional fashion.

Since the spools (11) and (12) are separate, they can be independently moved as is necessary to maneuver the kite (17) to do stunts well known to those who fly stunt kites.

Figure 7:
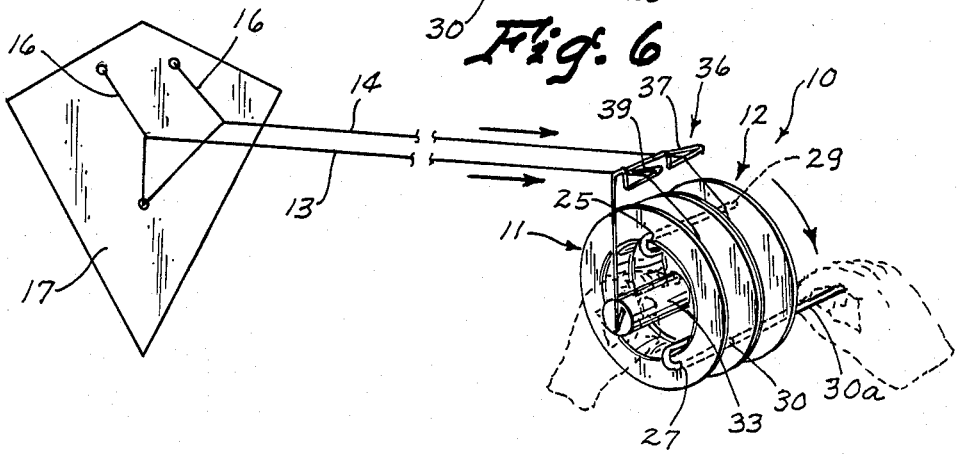
FIG. 7 is a perspective view similar to FIG. 1 but showing how the preferred embodiment is utilized to wind in the string of both spools simultaneously for bringing the kite down and winding up the reels once the kite has been brought down to earth.

If it is desired to stop flying the kite (17), the reeling apparatus can be installed as shown in FIGS. 6 and 7 to reel in both the lines (13) and (14) onto spools (11) and (12) respectively at one time. When it is desired to stop flying the kite (17), the kite is landed in a conventional fashion. Then, in order to wind the lines (13) and (14) onto the spools (11) and (12) to prevent tangling during transportation from place to place or during storage or the like, the spools (11) and (12) are placed together and the holes (25) and (26) are aligned and the holes (27) and (28) are aligned. Then the posts (29) and (30) are inserted through the holes (25–29) in the relationship shown in FIG. 6 and the handle (33) is inserted through the axle (31). The lines (13) and (14) are slipped into the loops (37) and (39) and then the user, while grasping the handle (33) with the left hand, can rotate both spools (11) and (12) simultaneously with the right hand to put the string back on the spools (11) and (12) for transportation from place to place and for storage.

It is to be understood that if a left-handed person is using the apparatus (10), the posts (29) and (30) can be inserted from the other side, first going through the holes in spool (12) and then through the holes in spool (11), and the handle (33) can then be inserted onto the axle (31) so that it extends out from the right side of the spools (11) and (12) as would be viewed in FIG. 6. Similarly, the guide loops (37) and (39) would be held in a proper position for use.

Accordingly, it will be appreciated that the preferred embodiment (10) disclosed herein does indeed accomplish the aforementioned objects and definitely minimizes the tangling and twisting of the control lines (13) and (14). Obviously, many modifications and variations of the present invention are possible in light of the above teachings. It is therefore to be understood that, within the scope of the appended claims, the invention may be practiced otherwise than as specifically described.

I claim:

1. Dual reel string winding and unwinding apparatus for use with stunt kites, said apparatus comprising:

a first spool adapted to be rotated about a rotational axis, said first spool including a first base member for holding string and a first pair of spaced apart flanges attached to opposite edges of said first base member and extending radially outwardly from said first base member, said first base member being disposed radially outwardly from said rotational axis;

a second spool adapted to be rotated about said rotational axis, said first spool including a second base member for holding string and a second pair of spaced apart flanges attached to opposite edges of said second base member and extending radially outwardly from said second base member, said second base member being disposed radially outwardly from said rotational axis;

a first pair of aligned holes extending through said first pair of flanges;

a second pair of aligned holes extending through said first pair of flanges;

a third pair of aligned holes extending through said second pair of flanges;

a fourth pair of aligned holes extending through said second pair of flanges;

a first post extending through said first and third pairs of aligned holes for causing said first and second spools to rotate together;

a second post extending through said second and fourth pair of aligned holes for causing said first and second spools to rotate together, said second post having a crank handle portion thereon extending a substantial distance beyond said fourth pair of aligned openings;

a handle having a central opening therein; and connection means disposed inside of said first and second base members and connected to one end of said first and second posts for rotatably receiving said handle thereon, said connection means extending into the central opening of said handle.

2. The apparatus of claim 1, including string guide means attached to said handle and including two open loops disposed radially outwardly from said first and second spools for guiding string onto or off from said first and second spools when said first and second spools are rotated.

3. The apparatus of claim 1 wherein said first and second post and said connection means comprises one piece of rigid wire formed into a first portion on one end of a shape resembling an S and a second portion on the other end connected thereto of a shape resembling a backward S.

* * * * *